US010202249B2

(12) United States Patent
Mitamura

(10) Patent No.: US 10,202,249 B2
(45) Date of Patent: Feb. 12, 2019

(54) SHEET FEEDING DEVICE, IMAGE READING DEVICE, AND IMAGE FORMING APPARATUS

(71) Applicant: CANON KABUSHIKI KAISHA, Tokyo (JP)

(72) Inventor: Akiyuki Mitamura, Toride (JP)

(73) Assignee: Canon Kabushiki Kaisha, tokyo (JP)

( * ) Notice: Subject to any disclaimer, the term of this patent is extended or adjusted under 35 U.S.C. 154(b) by 79 days.

(21) Appl. No.: 15/137,725

(22) Filed: Apr. 25, 2016

(65) Prior Publication Data

US 2016/0320735 A1 Nov. 3, 2016

(30) Foreign Application Priority Data

Apr. 30, 2015 (JP) ..... 2015-093501

(51) Int. Cl.
*B65H 3/06* (2006.01)
*G03G 15/00* (2006.01)

(52) U.S. Cl.
CPC ..... *B65H 3/0684* (2013.01); *B65H 3/0661* (2013.01); *G03G 15/602* (2013.01); *B65H 2301/4234* (2013.01); *B65H 2301/51256* (2013.01); *B65H 2404/1521* (2013.01); *B65H 2404/694* (2013.01); *B65H 2404/741* (2013.01);

(Continued)

(58) Field of Classification Search
CPC .. B65H 3/0684; B65H 3/0661; B65H 3/5215; B65H 3/5253; B65H 3/5261; B65H 3/54; B65H 3/66; B65H 3/68; B65H 2301/4234; B65H 2301/4422; B65H 2301/5125; B65H 2301/51256; B65H 2404/1421; B65H 2404/14211; B65H 2404/1422; B65H 2404/152; B65H 2404/1521;

(Continued)

(56) References Cited

U.S. PATENT DOCUMENTS 6,547,235 B2 * 4/2003 Higaki ..... B65H 3/0615 271/10.01
7,255,339 B2 * 8/2007 Hung ..... B65H 3/0684 271/121

(Continued)

FOREIGN PATENT DOCUMENTS

JP 11-301869 A 11/1999
JP 2008-68968 A 3/2008

*Primary Examiner* — Ernesto A Suarez
(74) *Attorney, Agent, or Firm* — Canon U.S.A., Inc. IP Division

(57) ABSTRACT

A sheet feeding device includes a stacking unit, a feeding unit, a rotating member, a separation unit, a holding unit, a swinging member, and a guiding unit. The stacking unit stacks sheets. The feeding unit feeds stacked sheets. The rotating member conveys sheets, and is on a feeding unit downstream side. The separation unit separates fed sheets one by one, and contacts the rotating member. The holding unit holds the feeding unit and rotating member, and is rotatable about a rotating member rotation shaft. The swinging members swingably disposed on the holding unit and the guiding unit on a swinging member lower side guides the sheets with contact. A first contact portion of the swinging member and the guiding unit is on a second contact portion upstream side, that is a rotating member/separation unit contact portion. A swinging member swinging shaft is on the first contact portion upstream side.

11 Claims, 9 Drawing Sheets

(52) U.S. Cl.
CPC .. *B65H 2405/3321* (2013.01); *B65H 2801/39* (2013.01)

(58) Field of Classification Search
CPC ..... B65H 2404/694; B65H 2404/6942; B65H 2404/741; B65H 2404/7414
USPC ..... 271/117, 118
See application file for complete search history.

(56) References Cited

U.S. PATENT DOCUMENTS

| | | | | |
|---|---|---|---|---|
| 7,516,953 | B2 * | 4/2009 | Lee | B65H 3/0684 271/117 |
| 7,571,905 | B2 * | 8/2009 | Kim | B65H 3/0684 271/109 |
| 8,313,097 | B2 * | 11/2012 | Kayama | B65H 3/0684 271/117 |
| 8,678,375 | B2 * | 3/2014 | Hanamoto | B65H 5/00 271/117 |
| 2016/0325954 | A1 * | 11/2016 | Uehara | B65H 3/0669 |
| 2017/0066618 | A1 * | 3/2017 | Adachi | B65H 1/04 |

* cited by examiner

SHEET FEEDING DEVICE, IMAGE READING DEVICE, AND IMAGE FORMING APPARATUS

BACKGROUND OF THE INVENTION

Field of the Invention

The present invention relates to a sheet feeding device that conveys a sheet to a predetermined position by separating and feeding sheets one by one, and an image forming apparatus that includes the sheet feeding device. For example, the present invention relates to a sheet feeding device applicable to an image forming apparatus such as a copying machine or a laser beam printer.

Description of the Related Art

A sheet feeding device feeds the sheets placed on a sheet feeding tray to the inside thereof through a pick-up roller and a conveyance roller.

In a case where a bundle of sheets is to be consecutively fed, separation unit is used. The separation unit separates the sheets fed by the pick-up roller, one by one by using a separation roller or a separation pad, and conveys the sheet to the inside of the sheet feeding device. The separation roller is pressed against and brought into contact with a conveyance roller, so as to be rotated and driven in a direction opposite to the sheet conveyance direction through a torque limiter. Further, the separation pad is pressed against the conveyance roller, and separates the sheets from each other with frictional resistance arising in a surface thereof. A pressure contact portion between the conveyance roller and the separation roller (separation pad) is referred to as a separation nip portion.

When a bundle of sheets is to be consecutively fed, a leading end of the sheet may be bent or damaged in a case where the leading end of the conveyed sheet is not fed to the separation nip portion or the leading end thereof is warped to cause a portion other than the leading end thereof to be fed into the separation nip portion. Therefore, it is essential to feed a sheet to the separation nip portion from the leading end thereof.

Japanese Patent Application Laid-Open No. 2008-68968 discusses a configuration in which a leading end of a sheet is smoothly guided to a separation nip portion through a swingable guiding plate that is arranged in parallel with a conveyance roller and supported by a rotating shaft disposed on a downstream side of the conveyance roller.

There is a demand in recent sheet feeding devices to support diversified sheet materials or a wider range of grammage. For example, although a range of supportable grammage has been 40 g/m$^2$ to 130 g/m$^2$ in the conventional technique, the range thereof is expanded to 30 g/m$^2$ to 200 g/m or more.

In particular, because thin paper with a grammage of 42 g/m$^2$ or less has low stiffness (hardness), behavior thereof is likely to be unstable when the thin paper is conveyed to a space on the upstream side of the separation nip portion.

Further, in recent sheet feeding devices, a number of sheets stackable on a sheet feeding tray tends to be increased in order to enable a large number of sheets to be conveyed by a single command. For example, although a number of stackable sheets has been 100 sheets in the conventional specification, the number thereof tends to be increased to 150 sheets to 200 sheets.

With respect to the sheet feeding device capable of stacking a large number of sheets, because a sheet bundle thickness in a maximum stacked state is increased, a height of the sheet feeding tray from a sheet supporting face to the separation nip portion is higher than the height in the conventional technique, on the upstream side of the separation nip portion.

In a sheet feeding tray configured to have a large height difference between the sheet supporting face and the separation nip portion, a distance between the sheet on the uppermost face of the sheet feeding tray and the separation nip portion becomes long when a small number of thin paper is stacked on the sheet feeding tray. Therefore, a sheet such as the thin paper having the low stiffness is likely to buckle at a position between the sheet feeding tray and the separation nip portion.

In order to solve the above problem, a swingable guiding member as described in Japanese Patent Application Laid-Open No. 2008-68968 may be employed. However, according to the configuration described in Japanese Patent Application Laid-Open No. 2008-68968, an angle between the swingable guiding member and a lower guide that faces the swingable guiding member will not be changed regardless of whether the sheets are fully stacked or the sheets of a small number are stacked thereon. Therefore, in a case where the angle between the swingable guiding member and the lower guide facing it, formed in a fully stacked state is set to be the appropriate angle, an abutting angle between a leading end of the sheet and the swingable guiding member, formed in the stacked state of a small number of sheets will be large.

Specifically, because a leading end of the sheet kept in a bookbinder as a file is likely to be warped upward, the abutting angle thereof will be larger. Therefore, there is a risk in which the sheet cannot be fed to the separation nip portion because the sheet cannot pass through a space between the swingable guiding member and the lower guide.

SUMMARY OF THE INVENTION

According to an aspect of the present invention, a sheet feeding device feeding a sheet includes a stacking unit configured to stack sheets on the stacking unit, a feeding unit configured to feed the sheets stacked on the stacking unit, a conveyance rotating member configured to convey the sheets, and which is disposed on a downstream side of the feeding unit in a sheet conveyance direction, a separation unit configured to separate the sheets fed from the feeding unit one by one, and which is disposed to contact the conveyance rotating member, a holding unit configured to hold the feeding unit and the conveyance rotating member, and which is disposed to be rotatable about a rotation shaft of the conveyance rotating member, a swinging member configured to guide the sheets, and which is swingably disposed on the holding unit, and a guiding unit configured to guide the sheets, and which is disposed on a lower side of the swinging member to contact the swinging member, wherein a first contact portion, that is a contact portion of the swinging member and the guiding unit, is disposed on an upstream side of a second contact portion, that is a contact portion of the conveyance rotating member and the separation unit, in the sheet conveyance, direction, and wherein a swinging shaft of the swinging member is disposed on an upstream side of the first contact portion in the sheet conveyance direction.

A sheet feeding device includes a pick-up roller, an arm for holding a conveyance roller, and a swinging member swingably disposed on the arm, wherein a swinging shaft of the swinging member is positioned on an upstream side in a sheet conveyance direction of a portion at which the swinging member contacts a pre-separation plate. Further features of the present invention will become apparent from the following description of exemplary embodiments with reference to the attached drawings.

DESCRIPTION OF THE EMBODIMENTS

Hereinafter, an exemplary embodiment of the present invention will be described in detail with reference to FIGS. 1 to 5.

Figure 1:
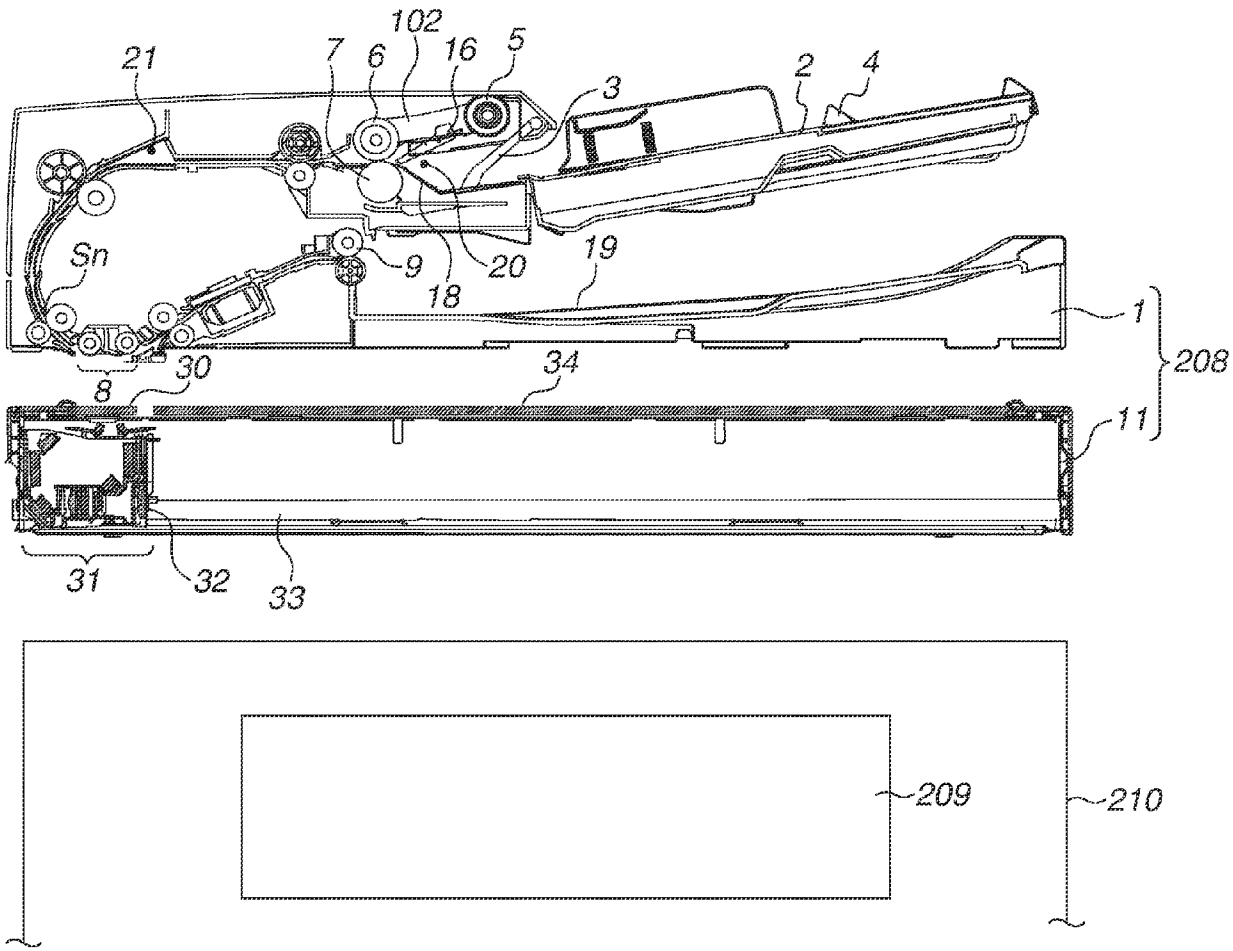
FIG. 1 is a diagram schematically illustrating an overall configuration of an image reading device including a sheet feeding device according to an exemplary embodiment of the present invention.

FIG. 1 is a diagram schematically illustrating an overall configuration of an image forming apparatus to which a sheet feeding device according to a first exemplary embodiment is applicable. The image forming apparatus includes an image reading device 208 and an image forming apparatus main unit 210.

The image reading device 208 includes an automatic document feeder (hereinafter, referred to as "ADF") 1 serving as a sheet feeding device and a reader 11 serving as an image reading unit for reading an image of a sheet conveyed to the ADF 1. The ADF 1 conveys a document (hereinafter, referred to as "sheet") an image of which is to be read by the reader 11.

The image forming apparatus main unit 210 having an image forming unit 209 is disposed on the lower side of the image reading device 208. The image forming unit 209 executes image formation through a known electro-photographic method. The image forming unit 209 includes a photosensitive member, an exposure device, a development device, a transfer device, and a fixing device. The exposure device forms an electrostatic latent image on the photosensitive member based on image information acquired by the image reading device 208. The development device develops the electrostatic latent image into a developed image with toner. The transfer device transfers the developed image onto a recording medium conveyed thereto. The fixing unit fixes the developed image on the recording medium onto the recording medium.

The ADF 1 according to the present exemplary embodiment includes a sheet feeding tray 2 serving as a stacking unit on the upper side thereof. The sheets placed on the sheet feeding tray 2 are sequentially fed by a pick-up roller 5 serving as a feeding unit from an uppermost sheet, and separated by a conveyance roller 6 (conveyance rotating member) and a separation roller 7 (separation unit) one by one. A length detection unit 4 includes a flag member disposed to project on a stacking face of the sheet feeding tray 2 and a sensor. The flag member is pressed down by the sheets placed on the sheet feeding tray 2, and the sensor is turned on and off according to the movement of the flag member to detect a length of the sheet in the sheet conveyance direction.

A supply path 20 includes a swinging member 16 and a pre-separation plate 18 (guiding unit). The pre-separation plate 18 is formed into a shape in dining upward from a sheet supporting face of the sheet feeding tray 2 in the sheet conveyance direction, so that the sheets placed on the sheet feeding tray 2 are guided to a conveyance path 21 positioned on the downstream side thereof.

The sheet conveyed to the conveyance path 21 is further conveyed onto a platen portion 8 serving as an image reading position of the ADF 1. A conveyance sensor Sn for detecting a conveyed sheet is disposed on the upstream side of the platen portion 8 in the sheet conveyance direction.

The reader 11 is arranged on the lower side of the ADF 1.

A scanning member 31 is disposed inside of the reader 11. In order to read image information of the sheet placed on a glass 34 arranged on the upper side thereof, the scanning member 31 scans the sheet in a lateral direction in FIG. 1 along a guiding member 33.

In a feeding-reading mode in which the sheet is conveyed by the ADF 1 and read by the scanning member 31 while the sheet is passing over a feeding-reading glass 30, the scanning member 31 is moved and fixed onto a lower side of the feeding-reading glass 30 when the sheet is being conveyed thereto.

A plurality of mirrors, an imaging unit, and a reading element 32 are arranged inside of the scanning member 31, so that an image of the sheet is formed on the reading element 32. The reading element 32 executes photoelectric conversion of the image in order to acquire image information. In addition, a complementary metal oxide semiconductor (CMOS) sensor or a charge coupled device (COD) sensor is used as the reading element 32. A contact-type optical system or a reduction-type optical system is used as a reading optical system.

The sheet passing over the feeding-reading glass 30 is discharged onto a sheet discharge tray 19 by a sheet discharge roller 9.

In addition, the sheets are stacked on the sheet feeding tray 2 in an order of the first page, the second page, the third page, the fourth page, and so on from the above. In a case where two-sided reading is to be executed, a front face of the first sheet as a reading target is the first page, whereas a back face thereof is the second page. The ADF 1 detects that the sheets are placed on the sheet feeding tray 2 through a setting detection sensor flag 3 and a setting detection unit 10 (photo-interrupter).

Figure 2:
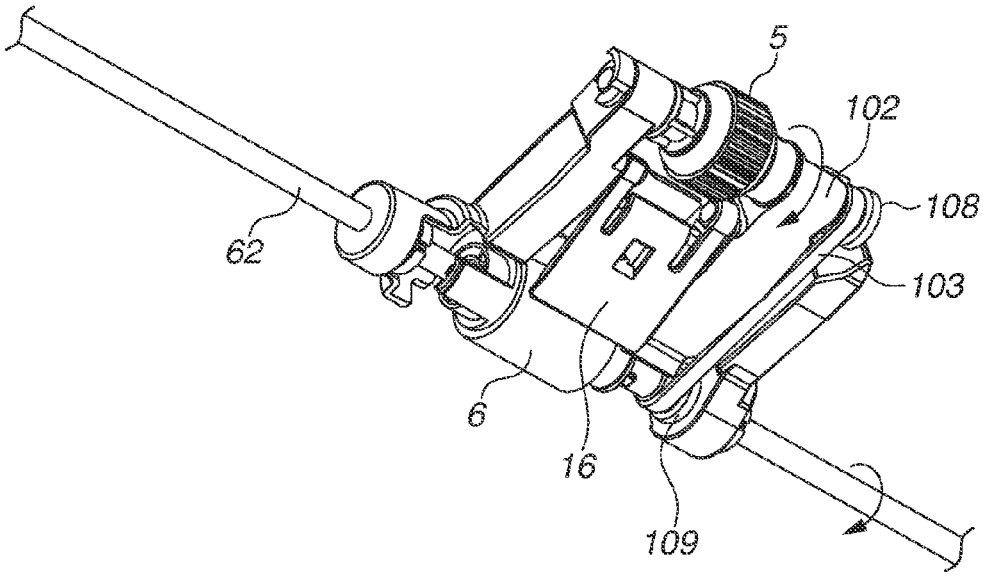
FIG. 2 is a diagram illustrating a perspective view of a sheet feeding device according to a first exemplary embodiment of the present invention.

FIG. 2 is a diagram illustrating a feeding unit including a swinging member according to the present exemplary embodiment.

The feeding unit includes the conveyance roller 6, the pick-up roller 5, a shaft 62, an arm 102 (holding unit), a timing belt 103, a pulleys 108, 109, and the swinging member 16. The shaft 62 coaxially holds the conveyance roller 6. The arm 102 makes the pick-up roller 5 rotate (move up and down) about the shaft 62. In other words, the arm 102 is rotatable about a rotation shaft of the conveyance roller 6. The timing belt 103 stretched around the pulleys 108 and 109 transmits driving force of a motor M (see FIG. 3) to the pick-up roller 5. A configuration of the swinging member 16 and an operation thereof will be described below in detail.

Figure 3:
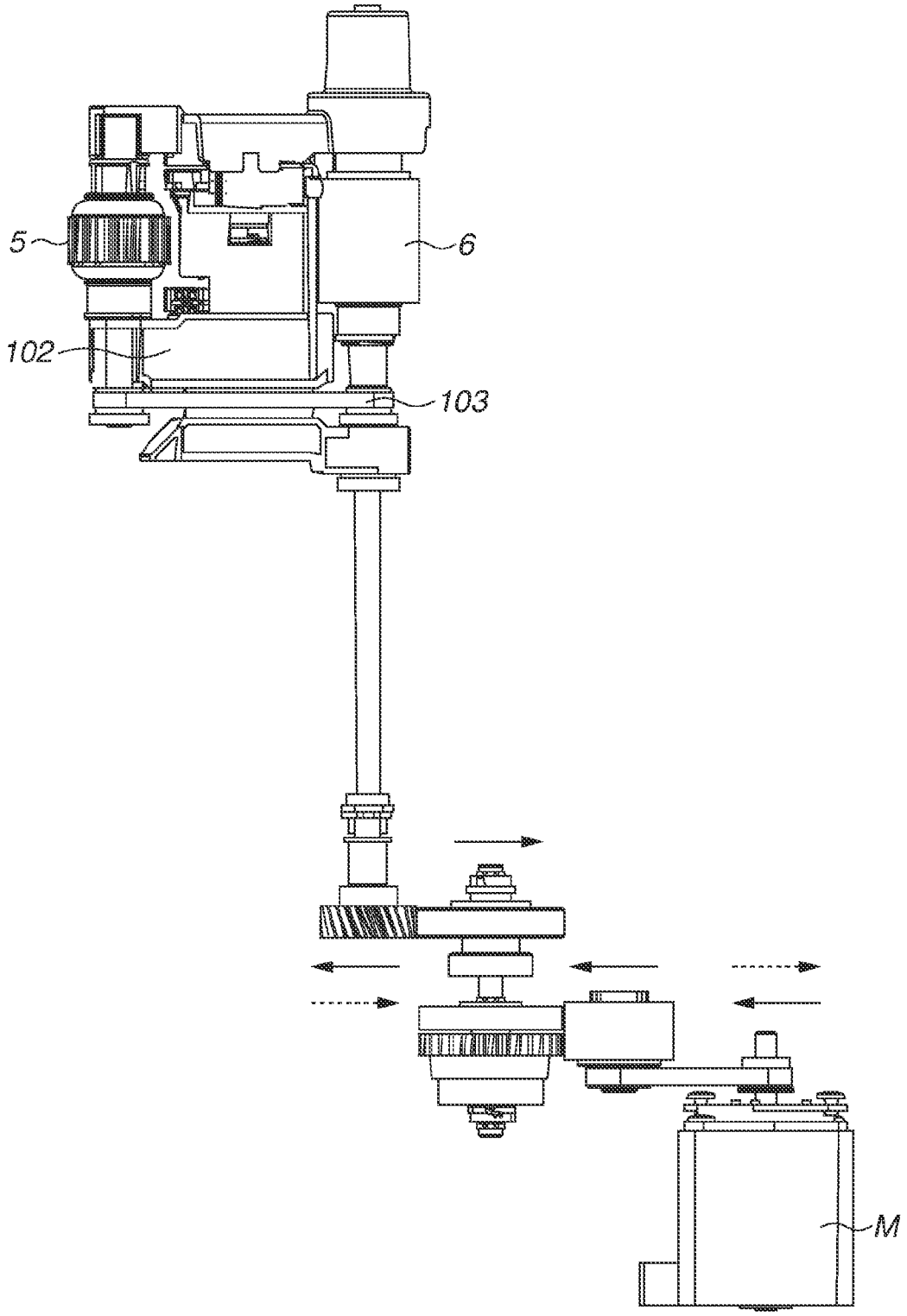
FIG. 3 is a diagram illustrating a driving configuration of the sheet feeding device according to the first exemplary embodiment of the present invention.

FIG. 3 is a driving configuration of the ADF according to the present exemplary embodiment. Arrows in FIG. 3 represent rotation directions of respective driving gears when viewed from the above. The driving gears rotate in directions indicated by solid arrows when the motor M is driven in a normal direction, and the driving gears rotate in directions indicated by dashed arrows when the motor M is driven in a reverse direction.

Figure 4:
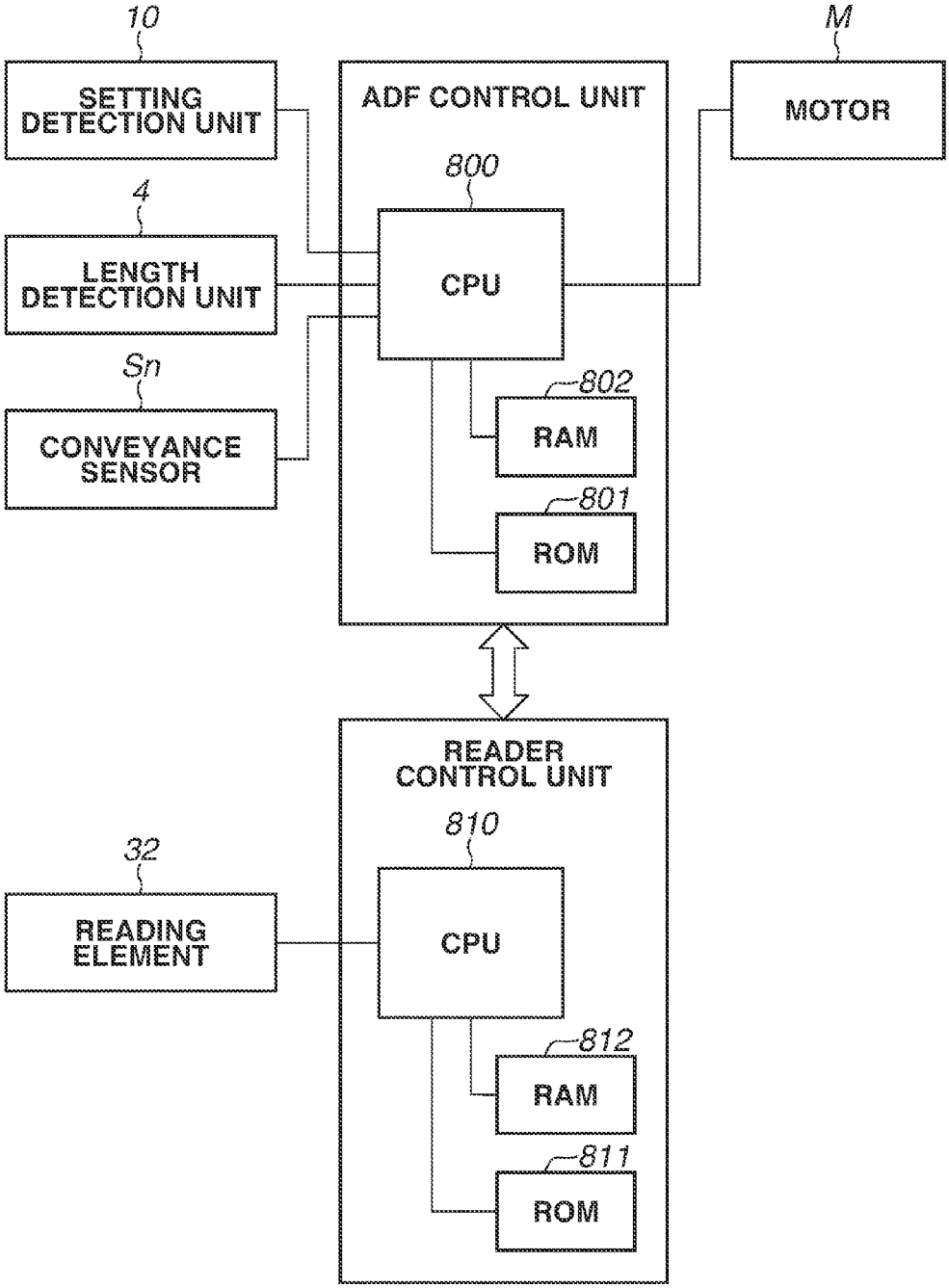
FIG. 4 is a block diagram illustrating a configuration of the sheet feeding device according to the first exemplary embodiment of the present invention.

FIG. 4 is a block diagram illustrating an electric configuration of the ADF 1. An ADF control unit includes a central processing unit (CPU) 800, a read only memory (ROM) 801, and a random access memory (RAM) 802. In cooperation with the ROM 801 and the RAM 802, the CPU 800 executes various kinds of control based on a program stored in the ROM 801. The reader control unit includes a CPU 810, a ROM 811, and a RAM 812. In cooperation with the ROM 811 and the RAM 812, the CPU 810 executes various kinds of control based on a program stored in the ROM 811. The CPU 800 is electrically connected to the setting detection unit 10, the length detection unit 4, the conveyance sensor Sn, and the motor M. The CPU 810 is electrically connected to the reading element 32. The CPU 800 and the CPU 810 are communicably disposed.

Figure 5:
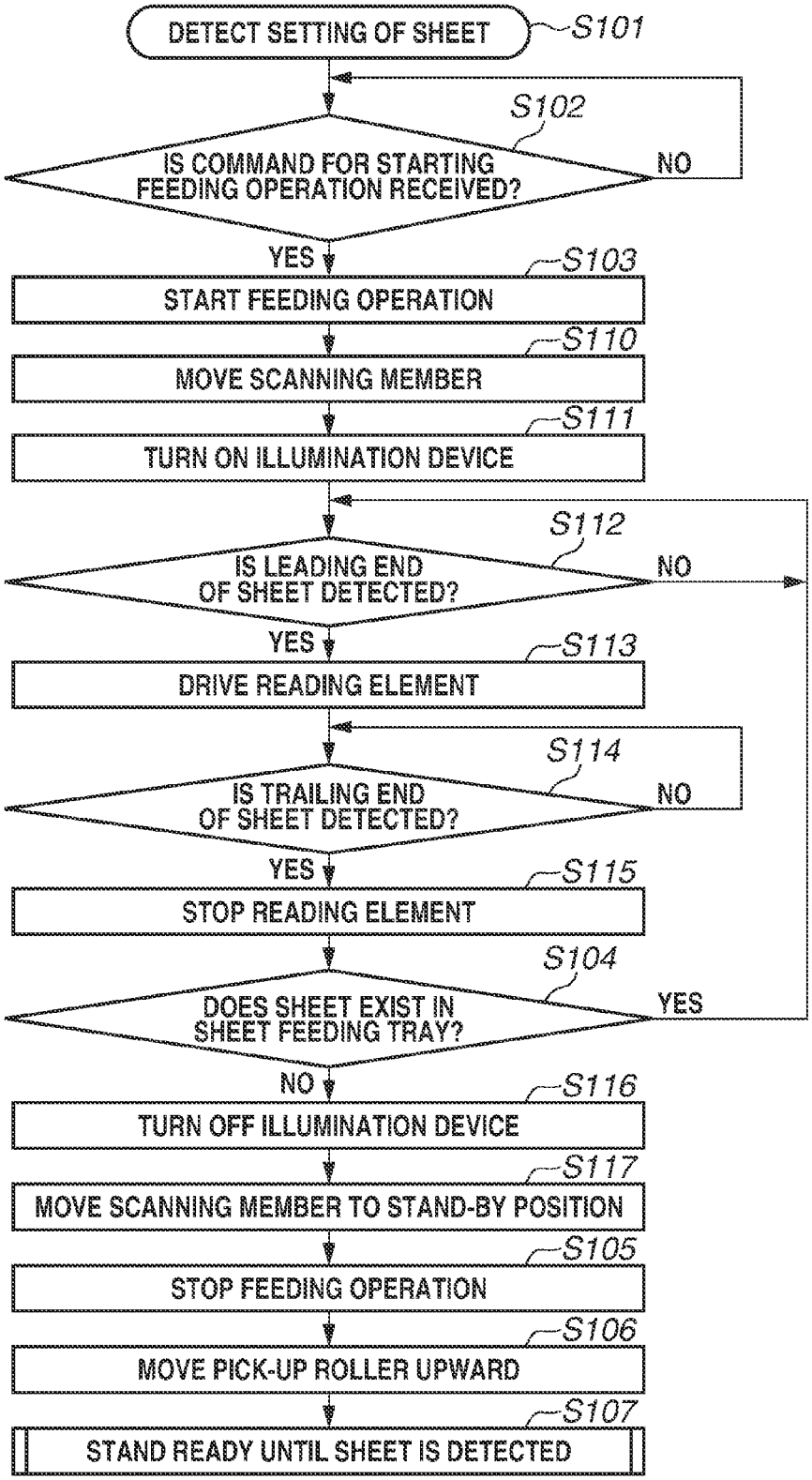
FIG. 5 is a flowchart illustrating a control sequence of a feeding operation of the sheet feeding device according to the first exemplary embodiment of the present invention.

FIG. 5 is a flowchart illustrating a control sequence for executing a feeding operation of the ADF 1.

Hereinafter, the feeding operation of the ADF 1 according to the present exemplary embodiment will be described with reference to FIGS. 3 to 5.

In step S101, the CPU 800 detects that the sheets has been set to the sheet feeding tray 2 when the sheets placed thereon cause the setting detection sensor flag 3 to rotate and shield a photo interrupter of the setting detection unit 10.

In step S102, in a state where the CPU 800 has detected setting of the sheets, the CPU 800 waits until a command for starting a feeding operation is input by a user.

When the command is input thereto (YES in step S102), the processing proceeds to step S103. In step S103, the CPU 800 starts the feeding operation.

At this time, the motor M rotates in a normal direction (i.e., direction indicated by the solid arrow in FIG. 3), so that the conveyance roller 6 and the pick-up roller 5 receive the driving force in the sheet conveyance direction, so that the arm 102 is lowered toward the stacked sheets.

At the same time, in step S110, the CPU 810 moves the scanning member 31 within the reader 11 to a lower portion of the feeding-reading glass 30. Then, in step S111, the CPU 810 drives an illumination device provided on the scanning member 31 in order to illuminate the sheet with illumination light.

In step S112, when the CPU 810 detects a leading end of the sheet through the conveyance sensor Sn (YES in step S112), the processing proceeds to step S113. In step S113, the CPU 810 drives the reading element 32, so that photoelectric conversion of illumination light emitted to and reflected on the sheet passing over the feeding-reading glass 30 is executed by the reading element 32, and image information is acquired thereby. The acquired image information is processed to read image data through image processing executed by the image processing unit.

In step S114, in a case where the CPU 810 detects a trailing end of the sheet through the conveyance sensor Sn (YES in step S114), the processing proceeds to step S115. In step S115, the CPU 810 stops driving the reading element 32 after predetermined time. Every time the conveyance sensor Sn detects the trailing end of the fed sheet, the CPU 800 checks a state of sheet detection executed by the setting detection unit 10. In step S104, in a case where the setting detection unit 10 detects the sheets, i.e., if it is determined that the sheets exist in the sheet feeding tray 2 (YES in step S104), the CPU 800 repeats the feeding operation.

When the conveyance sensor Sn detects a leading end of the subsequent sheet, the CPU 810 drives the reading element 32 again. While the sheets are being conveyed, driving of the reading element 32 is repeatedly turned on and off based on a detection result of the conveyance sensor Sn.

If the setting detection unit 10 detects that the sheets are not placed (NO in step S104), the processing proceeds to step S116. In step S116, the CPU 810 stops driving the illumination device. Then, in step S117, the CPU 810 moves the scanning member 31 to a stand-by position (i.e., shading correction position) from a position on the lower side of the feeding-reading glass 30. In step S105, the CPU 800 stops the feeding operation.

After stopping the feeding operation, in step S106, the CPU 800 makes the motor M rotate in the reverse direction indicated by the dashed arrow in FIG. 3. Because of the driving force of the motor M, the arm 102 is moved upward in a direction away from the sheet feeding tray 2. Then, in step S107, the ADF 1 is brought into a stand-by state until a sheet as a subsequent reading target is set to the sheet feeding tray 2 by the user and detected by the setting detection unit 10.

In the feeding operation, after the pick-up roller 5 has landed on the upper face of the sheet, the pick-up roller 5 applies a predetermined pressure onto the upper face of the sheet. A spring clutch or a compression spring is used as a unit for making an adjustment of the pressure applied onto the upper face of the sheet. In the present exemplary embodiment, a spring clutch is coupled between the shaft 62 and the arm 102.

When the motor M rotates in the normal direction, the arm 102 is rotated in a direction indicated by an arrow in FIG. 2, so that the pick-up roller 5 is moved downward. When the pick-up roller 5 abuts on the uppermost sheet on the sheet feeding tray 2 while the pressure of the pick-up roller applied to the sheet becomes greater than a predetermined value, the spring clutch slides between the shaft 62 and the arm 102. Through the function of the spring clutch described above, the pressure of the pick-up roller 5 applied to the sheet will not be increased, more than necessary.

On the other hand, when the motor M rotates in the reverse direction, the arm 102 is rotated in a direction opposite to the direction indicated by the arrow in FIG. 2, so that the pick-up roller 5 is moved upward. The spring clutch is locked when the pick-up roller 5 is moved upward.

Figure 6:
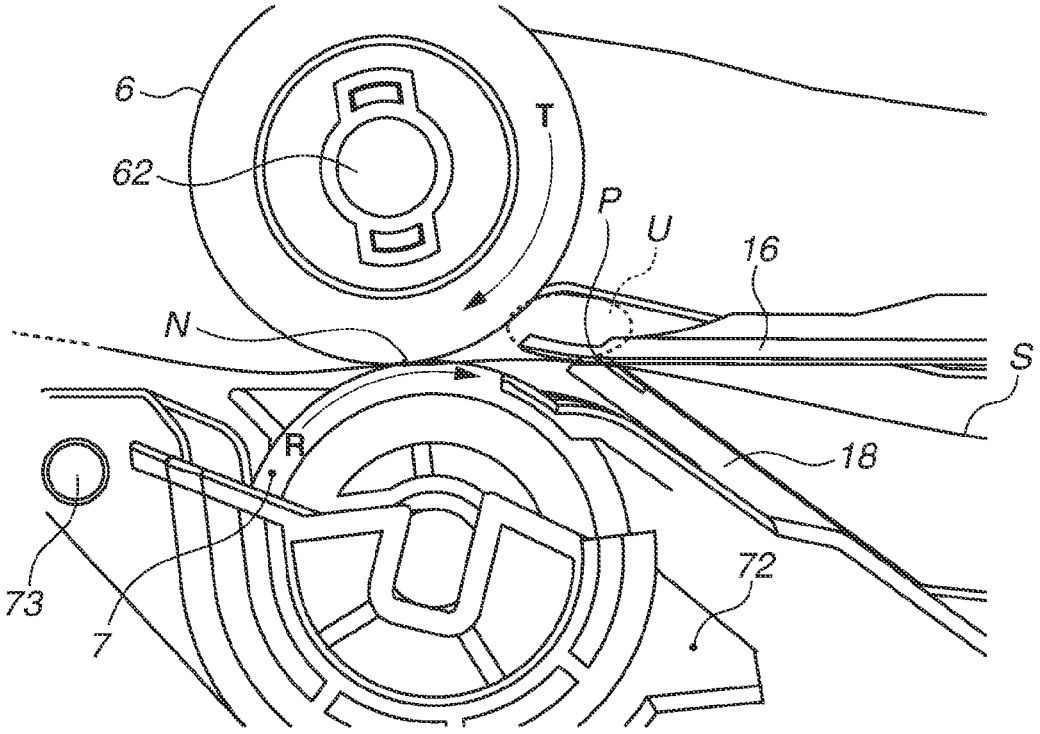
FIG. 6 is a diagram illustrating a cross-sectional view of the sheet feeding device according to the first exemplary embodiment of the present invention.

Subsequently, a configuration of the sheet feeding device according to the present exemplary embodiment will be described. FIG. 6 is a diagram illustrating a cross-sectional view of a sheet feeding portion of the sheet feeding device according to the present exemplary embodiment viewed in a sheet width direction that a direction orthogonal to the sheet conveyance direction.

The separation roller 7 and a torque loading unit (i.e., torque limiter) are coaxially connected to each other. The torque loading unit may be rotatably fixed to a frame 72 that holds the separation roller 7, or may be rotatably held by the frame 72 while receiving rotary power in a direction indicated by an arrow R in FIG. 6. In the present exemplary embodiment, the torque loading unit receives the rotary power in the direction indicated by the arrow R.

The torque loading unit disposed on the separation roller 7 makes the separation roller 7 rotate in the direction indicated, by the arrow R when a plurality of sheets is nipped between the conveyance roller 6 and the separation roller 7. On the other hand, torque of the torque loading unit is set in such a manner that the separation roller 7 is rotated in an opposite direction of the direction indicated by the arrow R because of the frictional force of the conveyance roller 6 (or sheet S) and the separation roller 7 when a single sheet is nipped between the conveyance roller 6 and the separation roller 7. In addition, the torque of the torque loading unit is also set in such a manner that the separation roller 7 is rotated in the opposite direction of the direction indicated by the arrow R when the conveyance roller 6 directly contacts with the separation roller 7.

The frame 72 that holds the separation roller 7 and the torque loading unit is held in a freely rotatable state by a rotating shaft 73 positioned on the downstream side in the sheet conveyance direction. The frame 72 is urged by an urging unit (not illustrated) in a direction in which the separation roller 7 contacts with the conveyance roller 6.

The conveyance roller 6 and the separation roller 7 form a nip portion N. The conveyance roller 6 receives driving force to rotate in a direction indicated by an arrow T in FIG. 6. Therefore, the separation roller 7 is rotated in a direction opposite to the direction indicated by the arrow R in FIG. 6 because of the frictional force in the nip portion N. The torque applied by the torque loading unit is set to be smaller than the frictional force in the nip portion N.

The pre-separation plate 18 is arranged on the upstream side of the conveyance roller 6 and the separation roller 7 in the sheet conveyance direction. In order to smoothly guide the sheet S placed on the sheet feeding tray 2 to the nip portion N, the pre-separation plate 18 has an inclined face inclining upward with respect to the sheet supporting face of the sheet feeding tray 2.

Figure 7A:
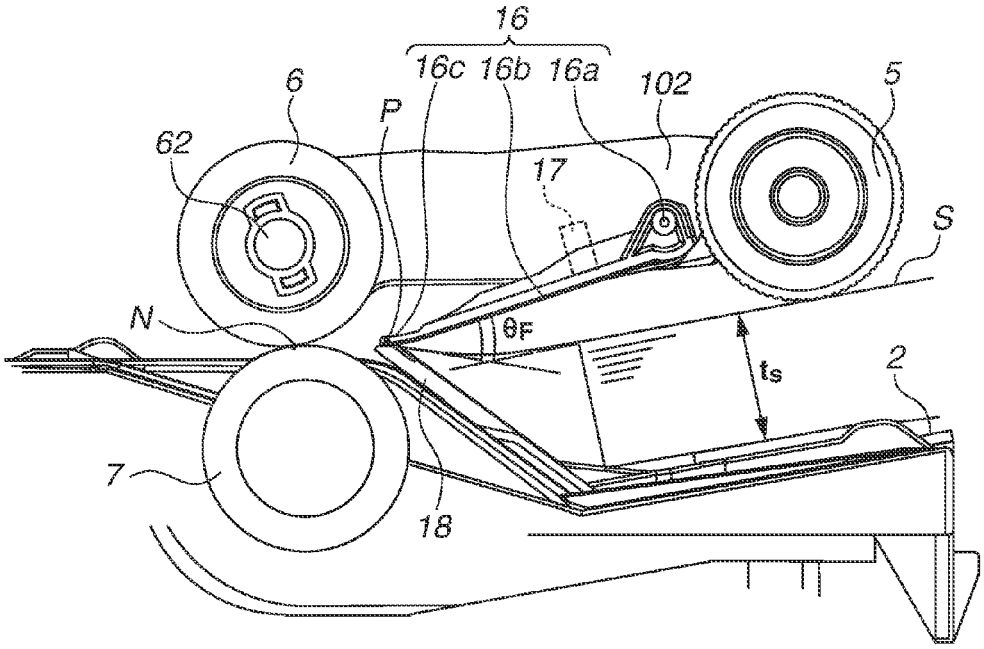
FIGS. 7A and 7B are diagrams illustrating cross-sectional views of the sheet feeding device according to the first exemplary embodiment of the present invention.
Figure 7B:
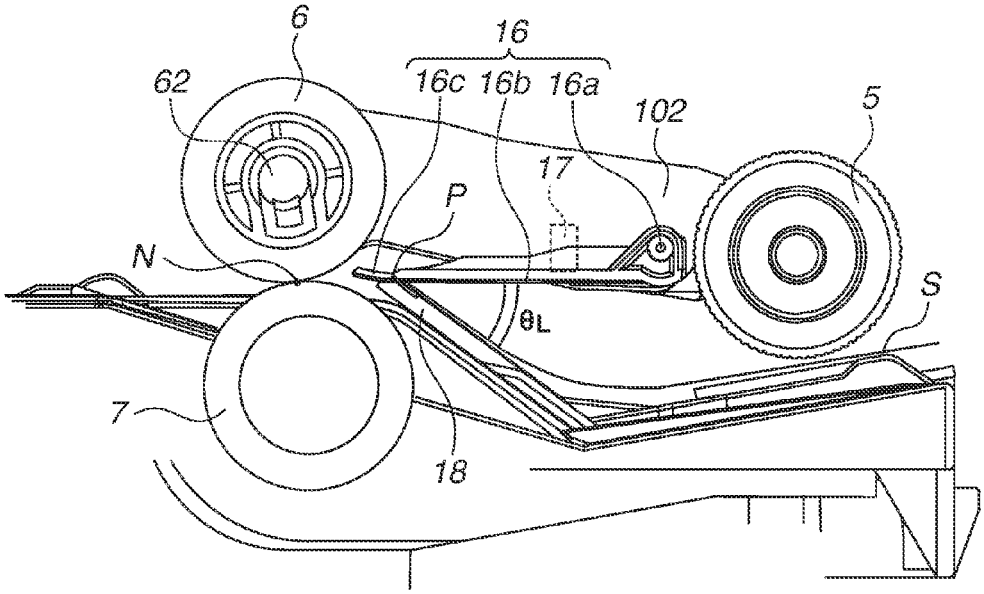

FIGS. 7A and 7B are diagrams illustrating a state where the sheet stacked on the sheet feeding tray 2 is fed by the pick-up roller 5 at the sheet feeding portion of the sheet feeding device according to the present exemplary embodiment.

FIG. 7A is a diagram illustrating a state where the sheets S are placed and fully stacked on the sheet feeding tray 2 (i.e., hereinafter, referred to as "fully stacked state"), whereas FIG. 7B is a diagram illustrating a stacked state of a small number of sheets, in particular, a stacked state of a single sheet.

A supply path 20 for guiding a sheet to the nip portion N between the conveyance roller and the separation roller 7 and further to the conveyance path on the downstream side thereof from the sheet feeding tray 2 is formed on the downstream side of the pick-up roller 5 in the sheet conveyance direction.

Because the pre-separation plate 18 inclines upward toward the downstream direction, the supply path 20 has such a shape in which a space between the upper and the lower guides becomes narrower toward the downstream direction when viewed in a cross-sectional direction.

Here, a configuration of the swinging member 16 attached to the sheet feeding device according to the present exemplary embodiment and operations thereof according to the present exemplary embodiment will be described with reference to FIGS. 6, 7A, and 7B.

The swinging member 16 is swingably held by a swinging shaft 16*a* relative to the arm 102. Similar to the arm 102 that is rotatable about the shaft 62 according to a sheet feeding position of the pick-up roller 5, the swinging member 16 is also rotatable about the shaft 62. The swinging member 16 has a guide face 16*b* for guiding the sheet on a sheet-passing side, and a downstream end 16*c* of the guide face 16*b* is configured as a swingable free end. The downstream end 16*c* of the swinging member 16 contacts with a leading end of the pre-separation plate 18 (i.e., a proximity of a downstream end portion in the sheet conveyance direction), so that the downstream end 16*c* and the leading end of the pre-separation plate 18 constitutes a contact portion P.

FIG. 7A is a diagram illustrating a state where the sheets are fully stacked on the sheet feeding tray 2. At this time, the pick-up roller 5 is in contact with an uppermost sheet of the sheet bundle, and the arm 102 is positioned accordingly. Because the arm 102 is rotated in the upward direction in the fully stacked state, a space U in FIG. 6 is increased to cause the sheet S to easily buckle. However, by urging the sheet downwardly with the guide face 16*b*, the sheet can be prevented from being warped in a direction of the space U, and thus possible to suppress the sheet from buckling.

A compression spring 17 serving as an urging unit is disposed on the opposite side of the guide face 16*b* in order to make the downstream end 16*c* of the swinging member 16 be urged to a leading end of the pre-separation plate 18 at the contact portion P. As another method for disposing the urging unit, a torsion coil spring may be coaxially attached thereto in order to apply urging torque around the swinging shaft 16*a*.

The swinging member 16 may be preferably formed of a material such as polyoxymethylene (POM) having low frictional resistance with respect to the sheet.

A leading end portion of the pre-separation plate 18 may be preferably formed of a material such as polyurethane rubber having high frictional resistance with respect to the sheet. In the present exemplary embodiment, a frictional coefficient of the leading end portion of the pre-separation plate 18 with respect to the sheet is set to be greater than a frictional coefficient of the downstream end 16*c* of the swinging member 16 with respect to the sheet. With this configuration, in a case where a plurality of sheets is simultaneously moved along the pre-separation plate 18 to enter the nip portion N, because of the frictional resistance applied from the leading end portion of the pre-separation plate 18, the sheet on the lower side reduces the speed for entering the nip portion N, so that it is possible to reduce a sheet separation failure occurring in the nip portion N. On the other hand, because the sheet on the upper side contacts with the swinging member 16 having the low frictional resistance, the occurrence of a guiding failure in which the sheet S is not easily guided into the nip portion N can be suppressed due to the frictional resistance of the downstream end 16*c* of the swinging member 16.

With reference to FIGS. 7A and 7B, description will be given to an effect on suppressing the buckling particularly occurring in a feeding operation of a sheet having a small grammage (i.e., thin paper), which can be obtained when the contact portion P is disposed on the upstream side of the nip portion N.

As described above, the maximum number of stackable sheets tends to be increased in the specifications of recent ADFs. If the maximum number of stackable sheets is increased, a sheet bundle thickness "ts" in the fully stacked state is increased, and thus the height of the sheet feeding tray 2 from a sheet supporting face to the nip portion N is increased on the upstream side of the nip portion N in the sheet conveyance direction.

This also indicates that a length of the inclined face portion of the pre-separation plate 18 is increased. If a length of the inclined face portion of the pre-separation plate 18 is shortened even though the maximum number of stackable sheets is increased, the pre-separation plate 18 will lose a function for guiding the sheet to the nip portion N because an angle between the sheet supporting face of the sheet feeding tray 2 and the inclined face portion of the pre-separation plate 18 approximates substantially perpendicular.

When the sheet S is moved and fed along the pre-separation plate 18 having the long inclined face portion in a stacked state of a small number of sheets, an operating point of the conveyance force of the pick-up roller 5 is positioned on the lower side of the nip portion N. Therefore, the conveyance force of the pick-up roller 5 applied to the sheet S in a vicinity of the leading end of the pre-separation plate 18 will act in the upward direction parallel to the inclined face portion.

In a case where only one sheet. S enters the nip portion N, the separation roller 7 is rotated in a direction opposite to the direction indicated by the arrow R in FIG. 6 because of the frictional force with the sheet. S. However, because of the torque load of the torque loading unit disposed coaxially with the separation roller 7, rotation speed of the separation roller 7 is slower than rotation speed of the conveyance roller 6, and thus slippage occurs between the separation roller 7 and the sheet S. At the same time, the sheet S receives frictional resistance in a direction opposite to the sheet conveyance direction from the separation roller 7.

When attention is given to the force acting on the upper and the lower faces of the sheet S, the upper face receives the conveyance force toward the downstream direction in the sheet conveyance direction from the conveyance roller 6, whereas the lower face receives the conveyance force toward the upstream direction in the sheet conveyance direction from the separation roller 7.

As described above, the sheet S is conveyed by receiving the upward force from the pick-up roller 5, and the force in a direction opposite to the conveyance direction is applied to the sheet S at the nip portion N. As a result, the sheet S deforms in a direction of the space U in FIG. 6, so as to be easily lifted upward at the upstream side of the nip portion N.

In a case were the space U is opened while the swinging member 16 is not disposed thereon, a lifted portion of the sheet that is not nipped by the nip portion N may contact with the conveyance roller 6. If the portion that is not nipped by the nip portion N contacts with the conveyance roller 6, the sheet S may buckle at a portion between that contact portion and a portion nipped by the nip portion N, and thus the sheet S may be bent or damaged.

Further, in a case where a plurality of sheets enters the nip portion N when the swinging member 16 is not disposed thereon, a sheet on the lower side thereof does not contact with the pre-separation plate 18. Therefore, a risk of the separation failure is increased because an effect on holding the sheet S caused by the frictional resistance of the pre-separation plate 18 will not be obtained.

In the present exemplary embodiment, because the swinging member 16 is disposed in such a manner that the sheet S is nipped between the swinging member 16 and the pre-separation plate 18 at the contact portion P located at the leading end of the pre-separation plate 18, the sheet S can be prevented from being lifted upward on the upstream side of the nip portion N. Further, because the guide face 16*b* of the swinging member 16 is configured of a plate-like member and extensively disposed up to the upstream region in the sheet conveyance direction, it is possible to widely exert an effect of the guide face 16*b* on suppressing the sheet S from lifting upward.

The contact portion P is provided on a position that is substantially corresponds to the position of the nip portion N in the width direction when viewed in the sheet conveyance direction. In other words, a region where the swinging member 16 contacts the pre-separation plate 18 and a region where the conveyance roller 6 contacts the separation roller 7 are arranged to overlap with each other in the width direction when viewed in the sheet conveyance direction. Further, the contact portion P and the nip portion N are relatively close to each other in the sheet conveyance direction. In the sheet feeding device according to the present exemplary embodiment, a distance between the nip portion N and the contact portion P is approximately 5 mm. With the above-described arrangement, because a movable range in the upper and lower directions can be regulated by the contact portion P, a leading end of the sheet S can be smoothly introduced to enter the nip portion N.

Further, according to the present exemplary embodiment, the swinging shaft of the swinging member 16 is disposed on the upstream side of the contact portion P in the sheet conveyance direction. Therefore, when the amount of sheets stacked on the sheet feeding tray 2 decreases to cause the arm 102 to be rotated, the swinging member 16 is also rotated accordingly. Then, the abutting angle θ between the sheet S immediately before entering the contact portion P and the swinging member 16 may vary along with the rotation of the arm 102. If the abutting angle θ is too small, the sheet S and the swinging member 16 interfere with each other, so that the sheet S cannot be successfully conveyed to the contact portion P. On the other hand, if the abutting angle θ is too large, buckling of the sheet S is likely to occur because the sheet S may abut on the swinging member 16 at a nearly right angle immediately before reaching the contact portion P.

Further, the swinging shaft of the swinging member 16 is disposed on the arm 102. Therefore, in comparison to the case where the swinging shaft of the swinging member 16 is disposed coaxially with a shaft of the pick-up roller 5, a degree of freedom in designing the swinging shaft of the swinging member 16 is increased. By placing the swinging shaft of the swinging member 16 at a suitable position of the arm 102, it is possible to make the swinging member 16 enter the space U in FIG. 6 in various, ways. Further, in comparison to the case where the swinging shaft of the swinging member 16 is disposed coaxially with the shaft of the pick-up roller 5, a distance between the swinging shaft of the swinging member 16 and a leading end of the swinging member 16 (i.e., an end portion in a vicinity of the space U) can be shortened. Therefore, magnitude of the moment acting on the leading end of the swinging member 16 from the sheet S can be reduced, and thus the swinging member 16 can efficiently suppress the sheet S from lifting upward.

According to the configuration described in the present exemplary embodiment, the abutting angle θ can be set within a suitable range regardless of the number of sheets S stacked on the sheet feeding tray 2. The abutting angle $\theta_F$ is set to 36 degrees ($\theta_F$=36°) in the fully stacked state as illustrated in FIG. 7A, whereas the abutting angle $\theta_L$ is set to 22 degrees ($\theta_L$=22°) in the stacked state of a small number of sheets as illustrated in FIG. 7B.

For example, a configuration of the swinging member 16 that makes the abutting angle θ be unchanged according to the rotation of the arm 102 is considered. For example, a configuration in which the swinging shaft of the swinging member 16 is disposed on the downstream side of the contact portion P in the sheet conveyance direction, or a configuration in which the swinging shaft of the swinging member 16 is supported by a member other than the arm 102 may be considered. In such a configuration, for example, in a case where the abutting angle θ is optimized in the fully stacked state, the abutting angle θ becomes too large in the stacked state of a small number of sheets, so that the sheet S conveyed to the contact portion P is likely to buckle.

A second exemplary embodiment is different from the first exemplary embodiment in the configuration of the swinging member. A configuration different from the first exemplary embodiment will be described while description will be omitted with respect to the configuration similar to that described in the first exemplary embodiment.

Figure 8A:
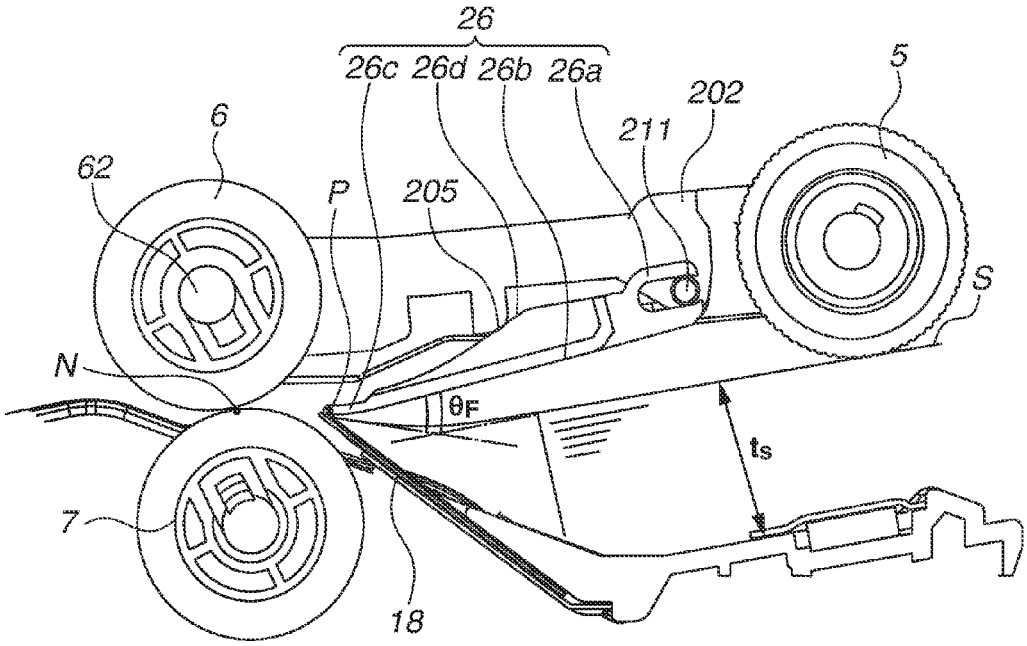
FIGS. 8A and 8B are diagrams illustrating cross-sectional views of a sheet feeding portion of a sheet feeding device according to a second exemplary embodiment of the present invention.
Figure 8B:
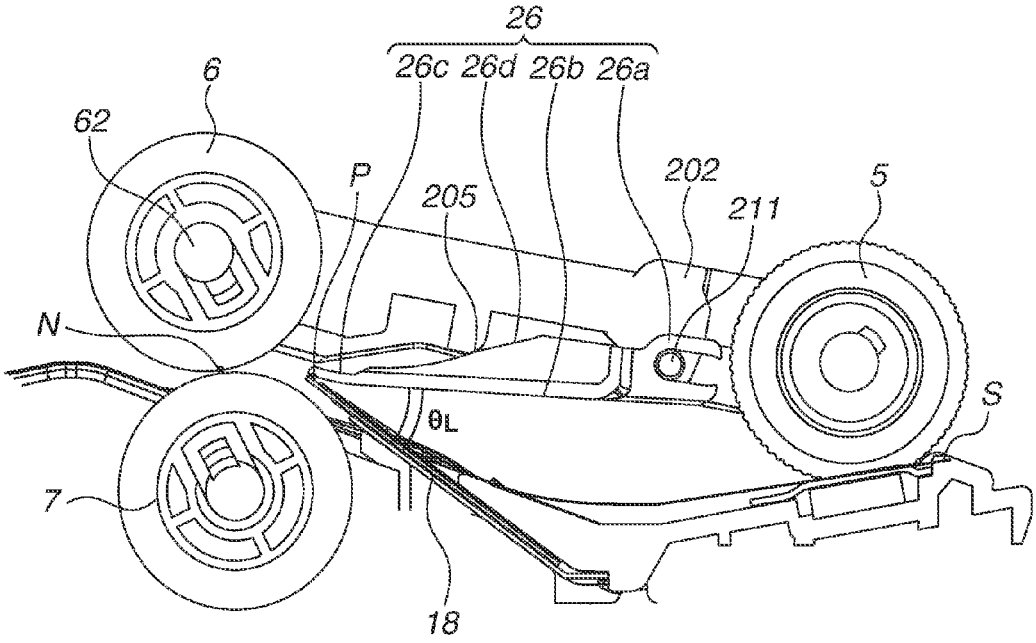
Figure 9:
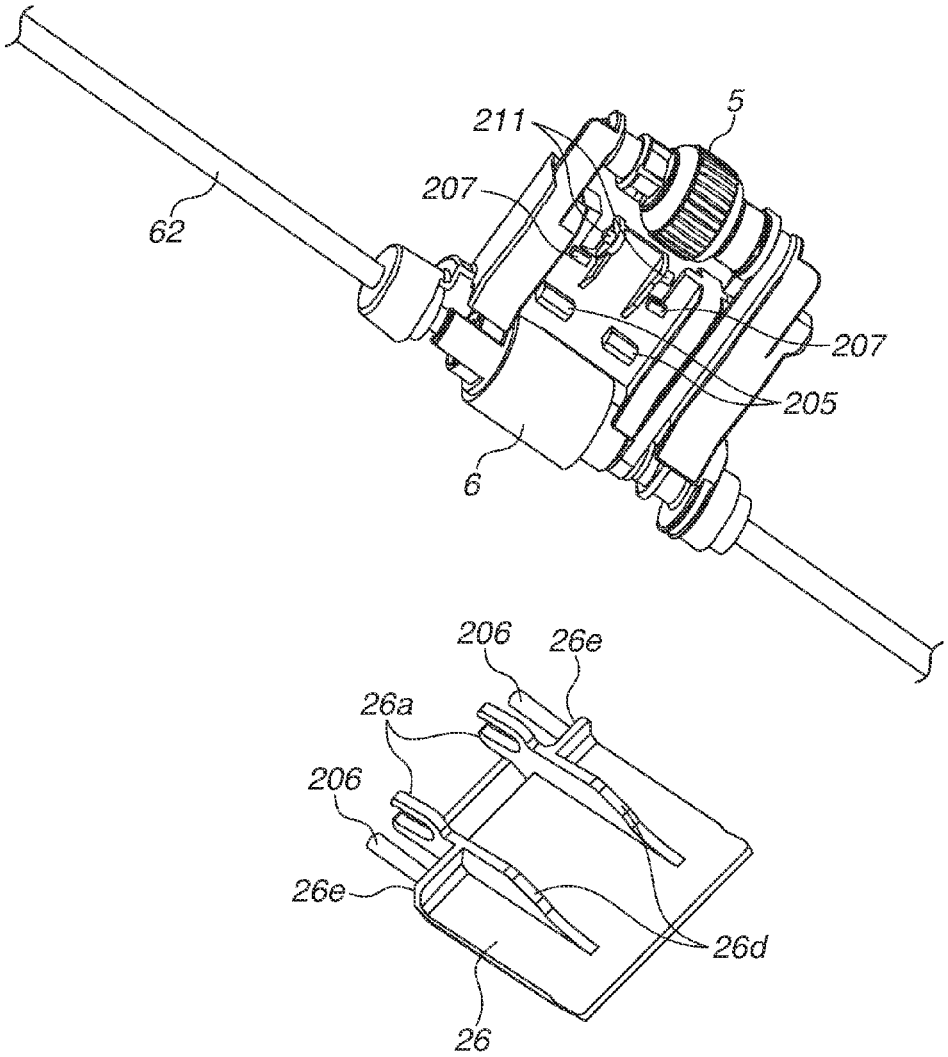
FIG. 9 is a diagram illustrating a perspective view of the sheet feeding device according to the second exemplary embodiment of the present invention.

FIGS. 8A and 8B are diagrams illustrating a configuration of a sheet feeding portion of the sheet feeding device according to the second exemplary embodiment of the present invention, which illustrate a state where the sheet S stacked on the sheet feeding tray 2 is fed by the pick-up roller 5. FIG. 9 is a diagram illustrating a perspective view of the sheet feeding portion of the sheet feeding device according a the present exemplary embodiment. In FIG. 9, for the sake of description, the diagram illustrates a state where an engagement state of a swinging member 26 and an arm member 202 is released, while a guide face 26*b* of the swinging member 26 faces downward.

FIG. 8A is a diagram illustrating a fully stacked state of the sheets S placed on the sheet feeding tray 2, whereas FIG. 8B is a diagram illustrating a stacked state of a small number of sheets S, in particular, a stacked state of a single sheet S.

According to the configuration described in the first exemplary embodiment (see FIG. 7), the abutting angle θ between the sheet S immediately before entering the contact portion P and the swinging member 16 slightly changes in the fully stacked state and the stacked state of a small number sheets. Therefore, in the first exemplary embodiment, the abutting angle θ is larger in the stacked state of a small number of sheets than in the fully stacked state.

In such a configuration, buckling of the sheet is likely to occur in a case where a sheet having a large abutting angle θ (e.g., a sheet kept in a bookbinder as a file, a leading end of which is bent upward) is conveyed thereto.

The swinging member 26 in FIG. 8A (8B) includes a swinging shaft bearing portion 26*a*, a guide face 26*b*, a downstream end 26*c*, and a cam face 26*d*. The swinging shaft bearing portion 26*a* is configured to be slidable relative to a shaft portion 211.

Further, the arm member 202 includes the shaft portion 211 that slidably and swingably holds the swinging shaft bearing portion 26*a* and an arm cam face 205 provided on a position corresponding to the cam face 26*d*. The arm cam face 205 abuts on an upper portion of the cam face 26*d*. A compression spring 206 (urging unit) is arranged on a position between a wall portion 26*e* of the swinging member 26 and a wall portion 207 of the arm member 202 (see FIG. 9). The compression spring 206 urges the swinging member 26 toward the downstream direction in the sheet conveyance direction.

FIG. 8A is a diagram illustrating a feeding state of the sheet S in the fully stacked state. The downstream end 26*c* contacts a leading end of the pre-separation plate 18 at an abutting angle $\theta_F$ of 22 degrees. At this time, the shaft portion 211 is positioned on the upstream side (i.e., on a side of the pick-up roller 5) in the sheet conveyance direction of a slidable region within the swinging shaft bearing portion 26*a*. This is because the swinging member 26 is urged to the downstream direction in the sheet conveyance direction by the compression spring 206.

FIG. 8B is a diagram illustrating a state where the sheet S is fed in the stacking state of a small number of sheets. At this time, the abutting angle $\theta_L$ of the leading end of the sheet S relative to the guide face 26*b* is approximately 22 degrees. In other words, the abutting angle θ in the fully stacked state and the abutting angle θ in the stacked state of a small number of sheets are substantially the same. Herein, "substantially the same" refers to a state where a difference between the abutting angle θ in the fully stacked state and the abutting angle θ in the stacked state of a small number of sheets is 10 degrees or less.

In the stacked state of a small number of sheet, the shaft portion 211 is positioned on the downstream side (i.e., on a side of the conveyance roller 6) in the sheet conveyance direction of the slidable region within the swinging shaft bearing portion 26*a*. This is because the cam face 26*d* abuts on the arm cam face 205 to make the swinging member 26 slide by receiving pushing force in the upstream direction when the swinging member 26 rotates about the shaft portion 211.

As described above, because the swinging member 26 is slid and moved by the arm cam face 205 and the cam face 26*d* in accordance with the rotation of the swinging member 26, the abutting angle θ of the leading end of the sheet S relative to the guide portion 26*b* can be kept substantially constant regardless of the number of stacked sheets.

According to the configuration described in the first exemplary embodiment, a distance between the downstream end 16*c* and the conveyance roller 6 is shortened along with the rotation of the swinging member 16 (i.e., the downstream end 16*c* in FIG. 7B is much closer to the conveyance roller 6 than the downstream end 16*c* in FIG. 7A). In such a configuration, when a plurality of sheets S enters the nip portion N to push the swinging member 16 upward, the swinging member 16 is rotated upward, so that the downstream end 16*c* contacts the conveyance roller 6. As a result, there is a risk in which a surface of the conveyance roller 6 is damaged.

In order to prevent the downstream end 16*c* from contacting the conveyance roller 6 even though the swinging member 16 is rotated, a distance between the downstream end 16*c* and the conveyance roller 6 has to be increased. However, this may result in an increase in size of the apparatus.

Furthermore, in a case where a distance between the downstream end 16*c* and the conveyance roller 6 is changed according to the rotation of the swinging member 16, the above distance is also changed when the amount of sheets stacked on the sheet feeding tray 2 is changed. In such a case, the sheet may enter the conveyance roller 6 in different ways depending on the amount of sheets stacked on the sheet feeding tray 2, and thus it is difficult to realize a stable feeding operation.

However, because the swinging member 26 in FIG. 8A (8B) is slid by the arm cam face 205 and the cam face 26*d* according to the rotation, a distance between the downstream end 26*c* and the conveyance roller 6 can be kept substantially constant.

In the present exemplary embodiment, although description has been given to a configuration in which the swinging member 26 is urged to the downstream direction in the sheet conveyance direction by the compression spring 206, the configuration is not limited thereto. The compression spring 206 may not have to be disposed if the swinging member 26 is configured to automatically move to the downstream direction in the sheet conveyance direction by its own weight in the fully stacked state.

In the above-described exemplary embodiment, the separation roller 7 has been described as an example of the separation unit that faces the conveyance roller 6. However, the same effect can be acquired by the operation of the swinging member according to the present invention even if a separation pad configured of a material having the high frictional coefficient is arranged thereon.

In the above-described exemplary embodiment, a sheet feeding device disposed on an electro-photographic image forming apparatus has been described as an example. However, the sheet feeding device according to the present exemplary embodiment may be applied to an ink jet printer that forms an image on a sheet by discharging ink.

In the above-described exemplary embodiment, although the ADF 1 disposed on the image reading device 208 has been described as an example of the sheet feeding device, the exemplary embodiment is not limited thereto. The configuration of the swinging member 16 may be applied to a feeding device that feeds a sheet-like recording medium to the image forming unit 209 disposed on the image forming apparatus main unit 210.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-093501, filed Apr. 30, 2015, which is hereby incorporated by reference herein in its entirety.

What is claimed is:

1. A sheet feeding device for feeding a sheet, the sheet feeding device comprising:

a stacking unit configured to stack sheets on the stacking unit;

a feeding unit configured to feed the sheets stacked on the stacking unit;

a conveyance rotating member configured to convey the sheets, and which is disposed on a downstream side of the feeding unit in a sheet conveyance direction;

a separation unit configured to separate the sheets fed from the feeding unit one by one, and which is disposed to contact the conveyance rotating member;

a holding unit configured to hold the feeding unit and the conveyance rotating member, and which is disposed to be rotatable;

a swinging member configured to guide the sheets, and which is swingably disposed on the holding unit; and a guiding unit configured to guide the sheets, and which is disposed on a lower side of the swinging member to contact the swinging member, wherein a first contact portion, that is a contact portion of the swinging member and the guiding unit, is disposed on an upstream side of a second contact portion, that is a contact portion of the conveyance rotating member and the separation unit, in the sheet conveyance direction, wherein a swinging shaft of the swinging member is disposed on an upstream side of the first contact portion in the sheet conveyance direction, and wherein the first contact portion and the second contact portion are arranged to overlap with each other in the sheet conveyance direction.

2. The sheet feeding device according to claim 1 further comprising an urging unit configured to urge the swinging member to the first contact portion.

3. The sheet feeding device according to claim 1, wherein an angle formed at the first contact portion between the guiding unit and the swinging member is assigned as an abutting angle theta (θ), wherein the feeding unit is movable to a first position and a second position which is lower than the first position, wherein the abutting angle θ is smaller when the feeding unit is at the second position than when the feeding unit is at the first position, and wherein the abutting angle θ is substantially the same regardless of a number of sheets stacked on the stacking unit.

4. The sheet feeding device according to claim 1, wherein the holding unit holds the swinging member to be slidable in the sheet conveyance direction with respect to the holding unit.

5. The sheet feeding device according to claim 4, further comprising an urging unit configured to urge the swinging member to a downstream direction in the sheet conveyance direction.

6. The sheet feeding device according to claim 4, wherein the swinging member includes a first cam face and the holding unit includes a second cam face contacting the first cam face, and wherein the first cam face and the second cam face apply force to the swinging member in order to make the swinging member slide to an upstream direction in the sheet conveyance direction when the holding unit rotates to make the feeding unit move downward.

7. The sheet feeding device according to claim 1, wherein the guiding unit is an inclined face portion inclined upward from a sheet supporting face of the stacking unit.

8. The sheet feeding device according to claim 1, wherein a friction coefficient of the guiding unit with respect to a sheet is greater than a friction coefficient of the swinging member with respect to a sheet.

9. The sheet feeding device according to claim 1, wherein the holding unit is rotatable about a rotation shaft of the conveyance rotating member.

10. An image reading device for reading an image of a sheet conveyed by a sheet feeding device, the image reading device comprising:

an image reading unit configured to read the image on a sheet conveyed by a sheet feeding device; and the sheet feeding device, wherein the sheet feeding device includes, a stacking unit configured to stack sheets on the stacking unit, a feeding unit configured to feed the sheets stacked on the stacking unit, a conveyance rotating member configured to convey the sheets, and which is disposed on a downstream side of the feeding unit in a sheet conveyance direction, a separation unit configured to separate the sheets fed from the feeding unit one by one, and which is disposed to contact the conveyance rotating member, a holding unit configured to hold the feeding unit and the conveyance rotating member, and which is disposed to be rotatable, a swinging member configured to guide the sheets, and which is swingably disposed on the holding unit, and a guiding unit configured to guide the sheets, and which is disposed on a lower side of the swinging member to contact the swinging member, wherein a first contact portion, that is a contact portion of the swinging member and the guiding unit, is disposed on an upstream side of a second contact portion, that is a contact portion of the conveyance rotating member and the separation unit, in the sheet conveyance direction, wherein a swinging shaft of the swinging member is disposed on an upstream side of the first contact portion in the sheet conveyance direction, and wherein the first contact portion and the second contact portion are arranged to overlap with each other in the sheet conveyance direction.

11. An image forming apparatus for forming an image on a sheet conveyed by a sheet feeding device, the image forming apparatus comprising:

an image forming unit configured to form the image on a sheet conveyed by a sheet feeding device; and the sheet feeding device, wherein the sheet feeding device includes:

a stacking unit configured to stack sheets on the stacking unit, a feeding unit configured to feed the sheets stacked on the stacking unit, a conveyance rotating member configured to convey the sheets, and which is disposed on a downstream side of the feeding unit in a sheet conveyance direction, a separation unit configured to separate the sheets fed from the feeding unit one by one, and which is disposed to contact the conveyance rotating member, a holding unit configured to hold the feeding unit and the conveyance rotating member, and which is disposed to be rotatable, a swinging member configured to guide the sheets, and which is swingably disposed on the holding unit, and a guiding unit configured to guide the sheets, and which is disposed on a lower side of the swinging member to contact the swinging member, wherein a first contact portion, that is a contact portion of the swinging member and the guiding unit, is disposed on an upstream side of a second contact portion, that is a contact portion of the conveyance rotating member and the separation unit, in the sheet conveyance direction, wherein a swinging shaft of the swinging member is disposed on an upstream side of the first contact portion in the sheet conveyance direction, and wherein the first contact portion and the second contact portion are arranged to overlap with each other in the sheet conveyance direction.

* * * * *